United States Patent [19]

Koula et al.

[11] 4,117,799

[45] Oct. 3, 1978

[54] APPARATUS FOR COATING BLANKS OR THE LIKE FORMED OF TEXTILE MATERIAL, ESPECIALLY CLOTHING INSERTS

[75] Inventors: Zdenek Koula, Regensdorf; Peter Nirk, Walchwil; Hans Wullschleger, Zurich, all of Switzerland

[73] Assignee: Stots & Co. AG, Zurich, Switzerland

[21] Appl. No.: 767,494

[22] Filed: Feb. 10, 1977

[30] Foreign Application Priority Data

Feb. 13, 1976 [CH] Switzerland ..... 1797/76

[51] Int. Cl.[2] ..... B05C 13/02

[52] U.S. Cl. ..... 118/6; 118/7; 118/213; 118/230; 118/236; 118/242; 118/500; 101/35; 214/1 BT

[58] Field of Search ..... 118/6, 7, 213, 230, 118/236, 239, 241, 242, 266, 500, 502; 101/35, 240; 214/1 BS, 1 BT, 1 BC, 1 BH, 6 S

[56] References Cited

U.S. PATENT DOCUMENTS

| | | | |
|---|---|---|---|
| 3,194,155 | 7/1965 | Davis, Jr. | 118/266 X |
| 3,370,845 | 2/1968 | Newcomb | 214/1 BT |
| 3,416,440 | 12/1968 | Miller et al. | 101/35 |
| 3,467,004 | 9/1969 | Best et al. | 101/35 |
| 3,486,441 | 12/1969 | Hillman et al. | 118/213 X |
| 3,638,564 | 2/1972 | Prange et al. | 101/35 |
| 3,844,249 | 10/1974 | Miller | 118/242 |
| 3,861,351 | 1/1975 | Bonwit et al. | 118/236 X |

FOREIGN PATENT DOCUMENTS

| | | | |
|---|---|---|---|
| 966,957 | 8/1964 | United Kingdom | 214/1 BT |

*Primary Examiner*—Mervin Stein
*Attorney, Agent, or Firm*—Werner W. Kleeman

[57] ABSTRACT

An apparatus for coating blanks, especially clothing inserts formed of textile material, comprising a device for the successive positioning of at least one blank, a coating device for the successive coating of at least one blank, and a heating device for the thermal treatment of the coated blank. There is further provided a conveyor device for transferring the blank from one device to the other. The conveyor device comprises a perforated plate forming a wall of a distributor chamber which can be connected with the suction side of a suction mechanism. The distributor chamber serves for the reception of at least one blank. The perforated plate has a density or proportion of perforations amounting to at least 10 percent of the surface area of the plate.

55 Claims, 11 Drawing Figures

APPARATUS FOR COATING BLANKS OR THE LIKE FORMED OF TEXTILE MATERIAL, ESPECIALLY CLOTHING INSERTS

BACKGROUND OF THE INVENTION

The present invention relates to a new and improved apparatus for coating blanks or the like, especially clothing inserts formed of textile material.

The problem of automatically coating blanks, especially clothing or garment inserts formed of textile material, has existed for quite some time. Oftentimes the attempts which have been made failed because the handling of the blanks, on the one hand, for delivery thereof to a coating device, and, on the other hand, during the coating due to the air permeability and possibly the traction sensitivity, especially in the wet condition, of the textile material, was associated with appreciable difficulties. In particular, attempts to transfer the blanks by means of conventional mechanical grippers and/or negative pressure grippers, have failed.

SUMMARY OF THE INVENTION

Hence, with the foregoing in mind it is a primary object of the present invention to provide a new and improved construction of apparatus for coating blanks, especially clothing or garment inserts formed of textile materials, in a manner not associated with the aforementioned difficulties and limitations of the prior art constructions.

Another and more specific object of the present invention aims at the provision of an installation for the coating of blanks, especially clothing inserts formed of textile material, wherein the previously discussed drawbacks are not present, and which installation is relatively simple in construction and design, economical to manufacture, extremely reliable in operation, requires a minimum of servicing, and is not readily subject to malfunction or breakdown.

Still a further significant object of the present invention is directed to the provision of a new and improved construction of coating apparatus for blanks, especially formed of textile material and useful as clothing inserts, wherein coating of the blanks can be accomplished expeditiously, reliably and economically and without damage or improper handling of the blanks.

Now in order to implement these and still further objects of the invention, which will become more readily apparent as the description proceeds, the apparatus for coating blanks, especially clothing inserts formed of textile materials, constructed according to the teachings of the present invention is manifested by the combination comprising:

(a) a device for the successive positioning of at least one blank;

(b) a coating device for the successive coating of at least one blank;

(c) a heating device for the thermal treatment of the coated blanks; and (d) a conveyor device for transferring the blanks from one device to the other, said conveyor device comprising a perforated plate forming a wall of a distributor chamber which can be connected with the suction side of a suction mechanism, the distributor chamber serving for the reception of at least one blank, and the perforated plate containing a proportion of perforations amounting to at least 10 percent of the surface area of the plate.

In the context of this disclosure, the term "coating" is to be understood as being employed in its broadest sense, and thus also encompasses the imbuing of the blanks or the like.

By virtue of the fact that there is employed a perforated or apertured plate for the conveying of a blank, which plate can be connected through the agency of a distributor chamber or compartment with a suction mechanism, such as an injector or a blower, the blank is positively held against the perforated plate by means of a suction current of relatively great volume and possessing a small negative pressure, although such blank which is formed of textile material as a general rule is porous and air pervious. Consequently, it is now possible to provide an apparatus or installation of the aforementioned general character which contains a device for the successive positioning of at least one blank, furthermore, a coating device for the successive coating of at least one blank and a heating device for the thermal treatment of the coated blank, such as by drying and condensating the coating agent. The blank can be faultlessly and accurately transferred from one device to the other by means of the conveying device.

The perforated or apertured plate preferably has a density or proportion of perforations exceeding 50 percent of the surface area of the plate.

The different devices are advantageously constructed such that they are suitable for simultaneously processing two or more blanks.

As to the positioning device such comprises stops or impact members for the alignment of the blanks, these stops preferably being brought into contact with the blanks. Further, these stops or impact members are preferably elevationally shiftable i.e. can be selectively lowered or raised in order not to impair the engaging action of the perforated plate of the conveyor device. It is preferable to also construct the deposit means or surface of the positioning plate likewise as a perforated or apertured plate, in order to enable the perforated plate of the conveyor device to suck-up the blank when engaging at the positioning device.

An especially advantageous coating device for coating the blanks is realized if the coating device comprises a printing machine, especially a screen printing machine. If desired, there also can be used spray devices for coating purposes.

A suitable construction of coating device advantageously contains a coating table having a perforated plate as the deposit surface for the blanks, and wherein the perforated plate, just as was the case for the conveyor device, forms a wall of a distributor chamber. This wall can be connected with the suction side of a suction mechanism and works in opposed relation to the conveyor device. The use of a large suction volume of the suction air is associated with the result that the negative pressure acting upon the blank is small and the blank nonetheless is positively retained in position. Additionally, there is avoided sucking of the coating material through the blank. Both in the case of the perforated plate used for the conveying of the blanks as well as the perforated plate used for the coating table, it is advantageous if the part thereof which is not employed for retaining the blank is covered by a mask or the like.

It is especially advantageous if the perforated plate of the coating table, following the coating of the blank, is not connected with the suction side of the suction mechanism, rather is advantageously at least partially connected with the blower side thereof during the transfer phase for the release of the blank, in order to facilitate such release and transfer of such blank.

The coating device is advantageously equipped with mechanism for infeeding the coating material or agent, and, if desired, for admixing additives thereto. This infeed mechanism is provided with a control device for adjusting the intervals between the individual conveying periods. An improvement of the dosing operation can be further obtained by also adjusting the length of the individual conveying periods or cycles at the control device.

The positioning device, the coating device and the heating device can be arranged in series following one another, but it is also possible to arrange these components along a pitch circle and at substantially uniform angular spacing from one another.

Continuing, the conveyor or conveying device can be equipped with at least one transfer head which can be raised and lowered and contains the perforated plate. This transfer head coacts in succession with all of the devices, i.e. the positioning device, the coating device and the heating device. The production capacity can be improved if there are employed a number of such transfer heads which can work in the same cycle. A particularly advantageous constructional manifestation of the invention is realized when the conveyor device comprises two interconnected elevationally shiftable transfer heads, each equipped with a perforated plate. These transfer heads can synchronously move back and forth, on the one hand, between the positioning device and the coating device, and, on the other hand, between the coating device and the heating device. The transfer heads can be similarly constructed. However, it is advantageous if the transfer head moving to-and-fro between the positioning device and the coating device is of simpler construction and for its control as a suction device only possesses a blower containing a cover which can be opened and closed by means of an actuation device. For receiving a blank the cover is opened and for the delivery thereof it is sufficient to close the cover, so that the suction force at the perforated plate sufficiently diminishes and releases the blank.

The transfer head which moves to-and-fro between the coating device and the heating device is advantageously connected by means of a switching or reversing device, preferably a slide with the suction mechanism, which transfer head can be selectively switched from the suction side to the blower side of the suction mechanism. The suction mechanism or device, preferably a blower, moreover is advantageously stronger than that of the transfer head which oscillates back and forth between the positioning device and the coating device. It is advantageous if the transfer head which moves to-and-fro between the coating device and the heating device possesses a greater suction force for removing the coated blank at the coating device, not only because the blank has become heavier due to the application of the coating, but because it can possibly partially adhesively bond to the coating table. For the transfer of the blank to the heating device the perforated plate then can be brought into flow communication with the blower side by means of the switching device, so that the removal of the blank can be facilitated by blowing air through the perforated plate. This is especially of advantage because the coated blank possibly can stick to the perforated plate.

When using a transfer head or a number of transfer heads in conjunction with successively arranged devices, the transfer heads are advantageously constructed as carriages which can be displaced from one device to the other and at that location can be lowered and raised. When using individual transfer heads there can be, however, realized an advantageous construction of the apparatus if the devices are arranged along a pitch circle and the transfer heads can be arranged in the form of a rotatable table. All of the transfer heads thus can be conjointly raised and lowered as well as pivoted in a particularly simple manner.

A further possibility of constructing the equipment resides in structuring the perforated plate so as to be of band-like and endless configuration and arranging such type perforated plate at least at the region of the positioning device and the coating device. The band-like perforated plate wipingly moves over the distributor chambers connected with the suction mechanism or device and can be raised and lowered therewith. In this case, the different devices must be arranged in a row behind one another. There is dispensed with the to-and-fro movement of the transfer heads.

It is especially advantageous to construct the apparatus such that the perforated plate is likewise band-like and endless and moves past at least the positioning device and the coating device, and, if desired, also the heating device. Further, the band-like perforated plate wipingly moves past or travels over distributor chambers connected with the suction mechanisms and arranged at least at the region of the positioning device and the coating device. In this case the band-like perforated plate can not only serve for conveying the individual blanks, but also simultaneously as the deposit or support surface for the blanks at the positioning device and as the coating table of the coating device. A transfer of the blank from one device to the other, by means of additional conveyor means, is then no longer needed.

A particularly advantageous embodiment of coating device comprises a stacking device following the heating device. This stacking device serves for the automatic aligned stacking of blanks arriving in an unaligned condition. The stacking device comprises an aligning device for conveying each blank in a first predetermined direction towards a first aligning element, this aligning device being displaceable in a second predetermined direction for aligning the blank at a second aligning element. Further, it contains a transfer device having a transfer head which is movable to-and-fro between the aligning device located in an aligning position and a stack depository or receiving means. The transfer head serves for grasping the double-aligned blank and for the transfer thereof to the stack depository means. The stack of blanks is therefore ready for further processing, storage and/or transport.

With the apparatus of the present invention there can be coated blanks formed of textile materials in a most simple and positive manner. This equipment is especially suitable for the coating of clothing inserts, such as, for instance, collar inserts and cuff inserts for shirts and blouses, as well as also reinforcement inserts for jackets, coats and the like. The apparatus is especially suitable for coating light clothing inserts having a surface weight of, for instance, 50 to 300 g/m$^2$.

BRIEF DESCRIPTION OF THE DRAWINGS

This invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
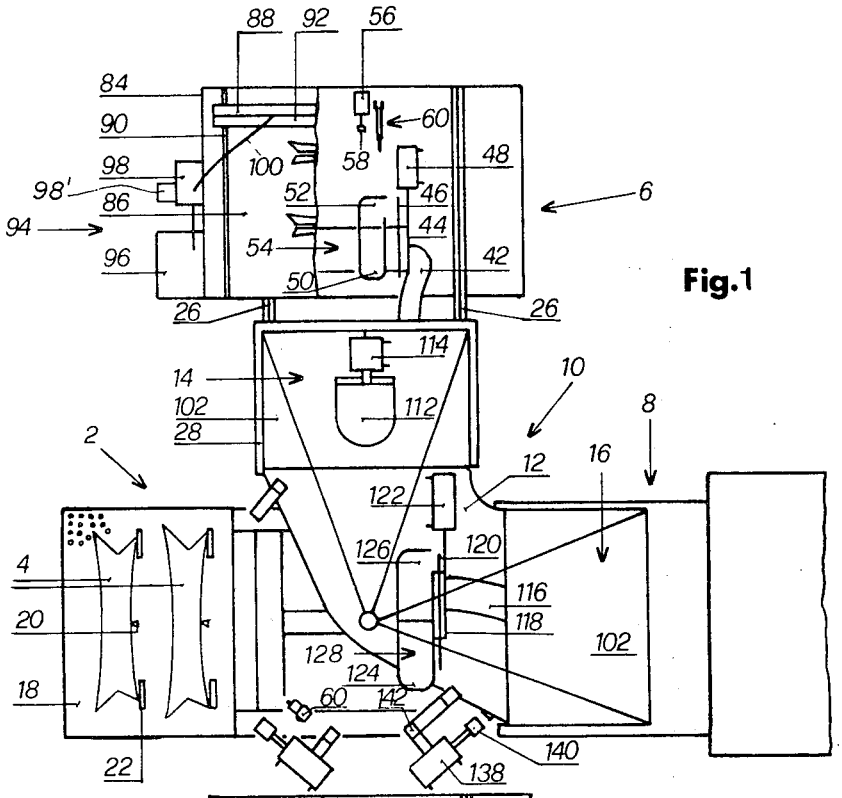
FIG. 1 is a top plan view of a first exemplary embodiment of coating apparatus or installation comprising a positioning device, a printing device and a heating device, which are arranged along a pitch circle, as well as containing a conveyor device equipped with a rotatable table.
Figure 2:
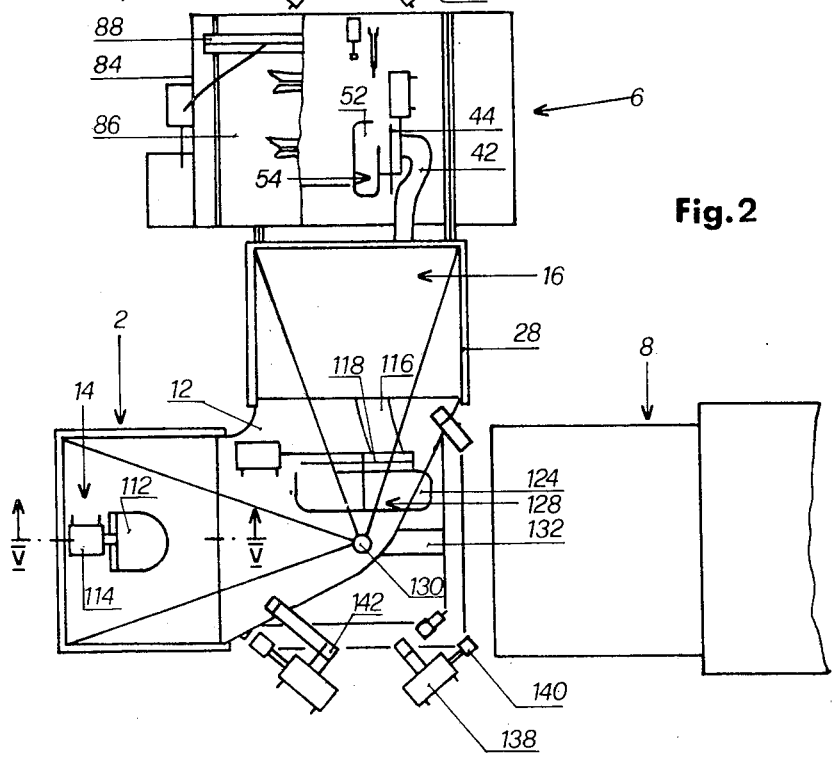
FIG. 2 illustrates the coating apparatus of FIG. 1 with the rotatable table rotated through 90°.
Figure 3:
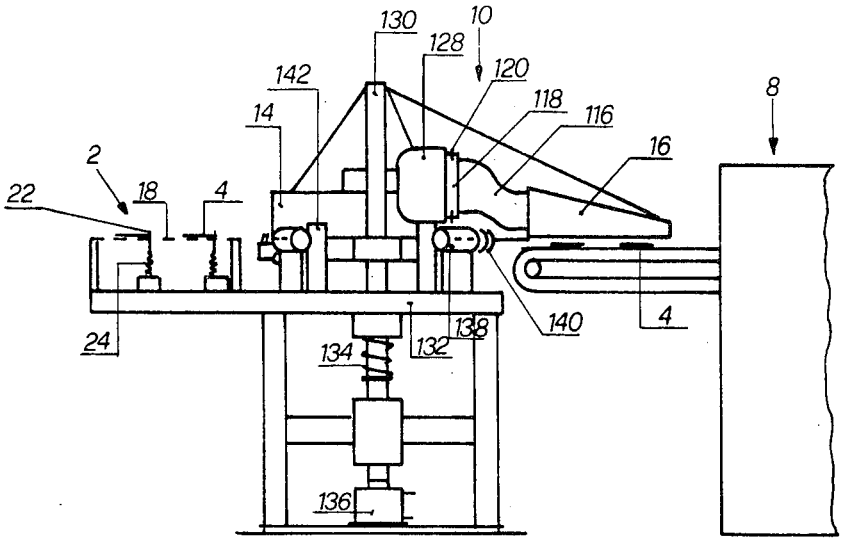
FIG. 3 is a side view of the coating apparatus of FIG. 1.

Describing now the drawings, in FIGS. 1 to 3 there is illustrated an exemplary embodiment of coating apparatus constructed as a so-called merry-go-round or rotary installation. A positioning device 2 for positioning two blanks 4, a coating device constructed as a printing device 6, especially a screen printing machine, for the simultaneous coating of two blanks, and a heating device 8 constructed as a band or belt dryer, for the thermal treatment as well as the drying of the coated blanks and the condensation of the coating agent, are arranged along a pitch circle. A conveyor device 10 equipped with a rotatable table 12 and two transfer heads 14 and 16 serves for the transfer of the blanks from the positioning device 2 to the printing device 6 and further to the heating device 8. The positioning device 2, the printing device 6 and the heating device 8 are each spaced through the same angular distance from one another, which in the embodiment under discussion amounts to 90°, and the rotatable table 12 of the conveyor device 10 therefore rocks back-and-forth through a pivotal angle of 90°.

As will be especially recognized from the showing of FIGS. 1 and 3, the positioning device 2 contains a depository or storage means 18 constructed in the form of a perforated plate and equipped with stops or impact members 20 and 22 which can be lowered i.e. elevationally positioned and, if desired, can be adjustable. These stops or impact members 20 and 22 bear against the springs 24 or equivalent structure and can shift back or deviate somewhat upon application of the transfer head 14. The depository means 18 is constructed as a perforated plate, as mentioned, and as particularly shown in FIG. 3, in order to render possible the sucking-up of the blanks.

Figure 4:
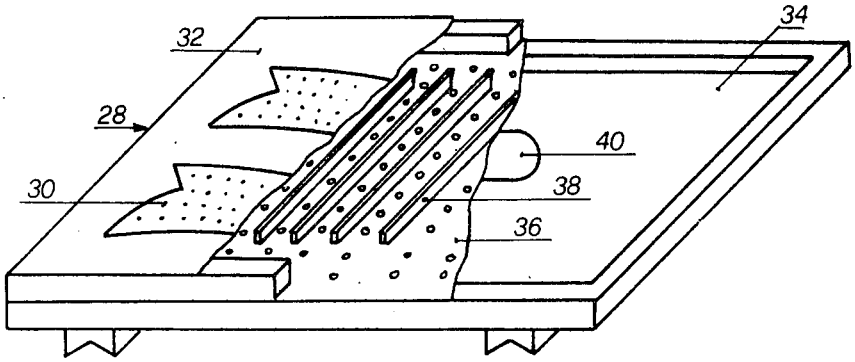
FIG. 4 is a perspective, partially sectional view, of the printing table of the printing device used in the arrangement of FIG. 1.

The printing device 6 illustrated in FIGS. 1, 2 and 4 constitutes a screen printing machine of conventional construction, which contains a printing table 28 serving as a coating table. This printing table 28 can be displaced along guide rails 26 between a receiving-transfer position for the reception of the blanks and a printing position. Further, this printing table 28 contains a perforated or apertured plate 30 serving for the deposition of the blanks 4. Those portions of the perforated plate 30 which are not required for holding the blanks can be covered by means of a mask 32 or equivalent structure. The perforated plate 30 forms a wall of a distributor chamber or compartment 34 having a perforated intermediate floor or base 36 extending parallel to the perforated plate 30. This intermediate floor 36, if desired, also can be dispensed with and in the embodiment under discussion is arranged for holding divider webs 38. The latter serve in the first instance as support means for the perforated plate 30, so that the blanks can be held positively and in a flat condition. The distributor chamber 34 is operatively connected by means of an opening 40 and a connection conduit 42 with a slide 44 serving as a switching or reversing device. This slide 44 is guided in the guides 46 and is shiftable preferably by means of a hydraulic or pneumatic actuation device 48 between the suction side 50 and the blower side 52 of a blower 54 serving as a suction mechanism or device.

The printing table 28 is constructed to be freely displaceable and contains as its drive means a respective pulse transmitter 56 arranged at the printing location and the receiving and transfer location, respectively. The pulse transmitters 56 can be actuated, for instance, electromagnetically or pneumatically, and are equipped with a plunger 58 which exerts a pushing force at the printing table 28 in order to cause displacement thereof. At each terminal position of the printing table 28 there is furthermore arranged a brake-aligning device 60 which initially brakes an arriving printing table and then aligns such in its exact position. Such brake-aligning device 60, which will be described more fully in conjunction with FIGS. 6 and 7, will be seen to contain an overhang arm 64 equipped with a roller or roll 62. This overhang arm 64 is mounted at its end opposite the roll 62 at a spring support 66 by means of a bearing 68. At the region between the roll 62 and the bearing 68 there engages at a bolt 70 a tension spring 72 or equivalent structure which preferably coacts with a not particularly illustrated, but conventional buffer or damper. The other end of the tension spring 72 is attached to the spring support 66. The overhang arm 64 coacts by means of its roll 62 with a substantially U-shaped bracket 72 which is attached to the printing table 28. In the braking position, the bracket 74 confronts the overhang arm 64, and the leg 76 thereof which confronts the overhang arm 64, with the overhang arm 64 located in its braking position, is constructed to be so short that it can move past the overhang arm 64 and its roll 62. The other leg 78 is longer than the leg 76 and equipped with a contact or cam surface 80 upon which travels the overhang arm 64 by means of the roll 62, when such arm is in its braking position. In the braking position of such overhang arm 64, the line of action of the tension spring 72, engaging at such overhang arm, with respect to the bearing 68 is located at the side confronting the arriving printing table. When the printing table arrives, then the roll 62 travels upon the contact or cam surface 80 and lifts the overhang arm 64 against the load of the tension spring 72, until its line of action passes through the axis of the bearing 68. Such raising of the overhang arm 64 against the force of the tension spring 72 brings about braking of the printing table. After passage of the line of action through the bearing 68 the tension spring 72 causes a further rocking of the overhang arm 64, which now engages by means of its roll 62 at the shorter leg 76 and moves the bracket 74 and thus the printing table against a stop 82 and holds it fixed at that location. Only by means of the pulse transmitter 56 is the table placed in movement opposite to the holding force of the braking-aligning device 60 and shifted towards the other position where there is effective the same braking-aligning device.

In the printing position the printing table 28 is located between a printing frame 84 which carries the printing template 86 and a squeegee carriage 88. The squeegee carriage 88 can be displaced upon the rails 90 over the printing template or stencil 86. This squeegee carriage 88 contains a squeegee 92 or equivalent structure and is supplied with coating agent or material by means of a supply device 94. The supply device 94 sucks-up the coating agent from a supply container 96 by means of a pump 98, constructed for instance as a hose pump, this coating agent being delivered by means of the delivery or infeed line or conduit 100 to the squeegee carriage 88. The pump 98, if desired, also can be used for the admixing of additive materials or agents. Further pump 98 can be equipped with a suitable control device 98' for adjusting the intervals between the conveying periods. The control device 98' is preferably constructed such that it is also possible to regulate the length of the conveying periods or cycles.

Figure 5:
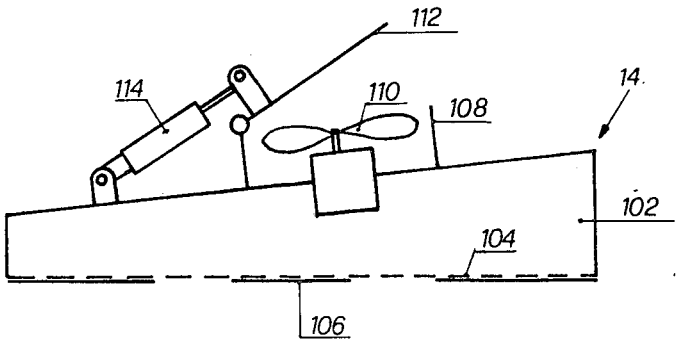
FIG. 5 is a sectional view of the transfer head of the conveyor device of the coating apparatus of FIG. 2, taken substantially along the line V—V thereof.

The rotatable table 12 of the conveyor or conveying device 10 contains two transfer heads 14 and 16, which may be similarly constructed, however are preferably different in construction. The first transfer head 14 which oscillates between the positioning device 2 and the printing device 6 has been illustrated in sectional view in FIG. 5. It will be seen to comprise a distributor chamber or compartment 102 which is equipped with a perforated plate 104 serving to receive the blank 4. The surface portion of the perforated plate 104 which is not used for taking-up a blank 4 is covered with a mask 106 in order to make optimum use of the suction air current. Connected with the distributor chamber 102 by means of a connection piece 108 is a blower 110 serving as a suction mechanism or device, the outlet of which is covered by a cover member 112. An actuation device 114, preferably constructed as a pneumatic piston-and-cylinder unit, serves for opening the cover or cover member 112 whenever it is intended to receive and hold a blank and for closing such cover when there should be transferred a blank. This construction of the transfer head enables operating the blower 110 without interruption.

The other transfer head 16 is constructed analagous to the transfer head 14 as concerns the distributor chamber, perforated plate and mask. The distributor chamber 102 is connected by means of a connection conduit or line 116 with a slide 118 serving as a switching or reversing device. The slide 118 is guided in the guides 120 and is displaced by means of an actuation device 122, preferably constructed as a pneumatic piston-and-cylinder unit, between the suction side 124 and the blower side 126 of a blower 128 serving as a suction mechanism. The slide 118, depending upon the required suction- or blower capacity if desired can only partially be in operable association with the suction side and/or the blower side.

The rotatable table 12 of the conveyor device 10 is mounted to be elevationally displaceable i.e. can be raised and lowered at a vertical shaft 130 which is freely rockable in a frame 132. This rotatable table 12 can be downwardly pre-biased by means of a spring 134 or equivalent structure. A lifting device 136 preferably constructed as a pneumatic piston-and-cylinder unit, serves for lifting the rotatable table 12 against the prebias of the spring 134. In order to rock the rotatable table 12 there are arranged pulse transmitters 138 at each adjusted position, analagous to the arrangement of the printing table 28. These pulse transmitters 138 are again preferably constructed as pneumatically operated piston-and-cylinder units and contain plungers 140 for pushing the rotatable table 12.

Figure 7:
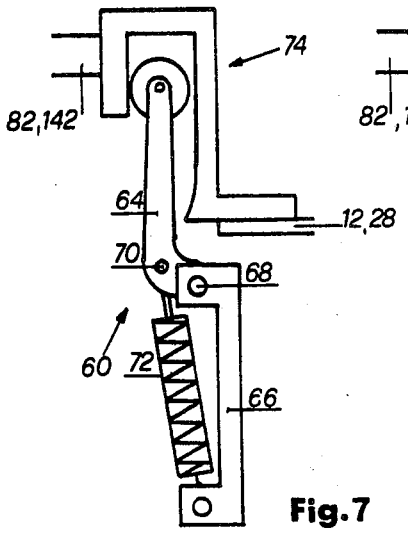
FIG. 7 illustrates the brake-aligning device of FIG. 6 in its aligning position.
Figure 6:
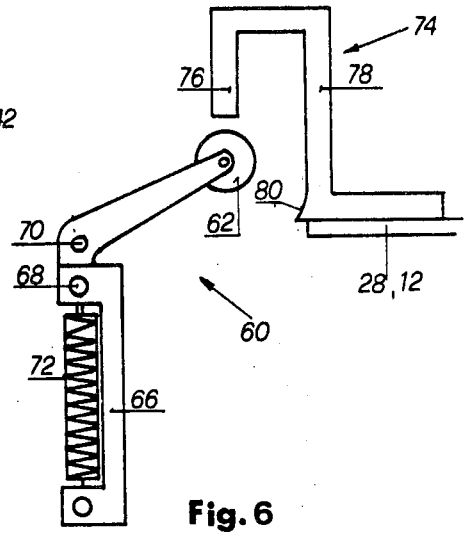
FIG. 6 illustrates a brake-aligning device for the printing table and the rotatable table of the coating apparatus of FIG. 1 and shown in its braking position.

Furthermore, at the terminal or end positions of the rotatable table 12 there are arranged the brake-aligning devices 60 of the type described in conjunction with FIGS. 6 and 7. They serve for braking the rotatable table 12 and for aligning such rotatable table at the momentary terminal positions, and hold such rotatable table in each case against a stop or impact member 142.

Having now had the benefit of the foregoing discussion of the construction of an exemplary embodiment of coating apparatus its operation now will be considered and is as follows:

With the position of the rotatable or rotary table 12 shown in FIG. 1 the positioning device 2 is free and it is possible to arrange manually or, if desired, automatically blanks 4, which here have been assumed to constitute collar inserts for shirts, at the stops or impact members 20 and 22. During this phase, the printing table 28 is located in its receiving or takeup position for the blanks, and the distributor chamber 34 of the printing table 28 is flow connected by means of the connection line or conduit 42 and the slide 44 with the suction side 50 of the blower 54, in order to thus receive blanks from the transfer head 14 which bears at the printing table 28. In this phase, the cover 112 of the transfer head 14 is closed, so that the transfer head 14 is not exposed to any suction force and the blanks can be received by the printing table 28. At the same time the transfer head 16 is located over the conveyor band of the drying device 8. To facilitate the transfer of the coated blanks, in this case the distributor chamber flow communicates via the connection conduit or line 116 and the slide 118 partially with the blower side 126 of the blower 128, so that the blanks can be ejected from the perforated plate of the transfer head 16.

FIG. 2 illustrates that position of the rotatable table where the first transfer head 14 removes blanks from the positioning device 2. To this end, the cover 112 of the blower 110 is opened by means of the actuation device 114, so that air can be sucked-up by means of the perforated plate 104 and the blanks 4 can be engaged. The second transfer head 16 is located at the printing device where the printing table 28 is disposed in the delivery or transfer position for the coated blanks. In order to facilitate the transfer of the blanks from the printing table 28, its distributor chamber 34 is connected by means of the connection conduit or line 42 and the slide 44 at least partially with the blower side 52 of the blower 54. The distributor chamber of the second transfer head 16, on the other hand, is connected by means of the connection line or conduit 116 and the slide 118 with the suction side 124 of the blower 128, so that the coated blanks can be transferred from the printing table 28 to the second transfer head 16.

In the operating conditions illustrated between FIGS. 1 and 2 there occurs the coating of the blanks, and the printing table 28 remains connected by means of the slide 44 with the suction side 50 of the blower 54 and is displaced beneath the printing frame 84. After lowering the printing frame 84, the squeegee carriage 88 wipingly contacts the printing template or stencil 86. After lifting the printing frame 84, the printing table 28 can be shifted into the receiving- and transfer position.

Figure 8:
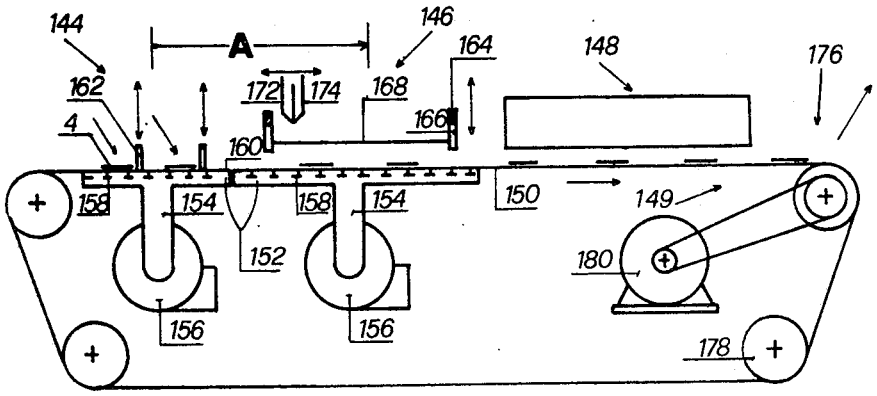
FIG. 8 illustrates a second exemplary embodiment of coating apparatus, shown in sectional side view, wherein the positioning device, printing device and heating device thereof are arranged in a row, and the perforated plate is constructed to be band-like and endless i.e. is constructed as a conveyor band which operatively connects all of the devices.
Figure 9:
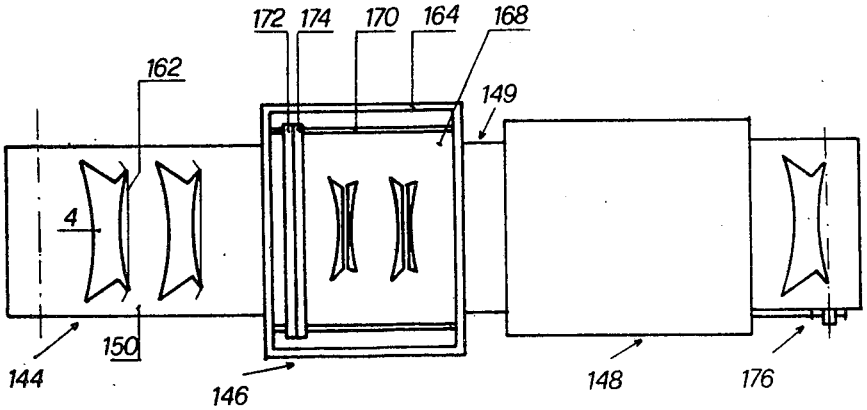
FIG. 9 is a top plan view of the coating apparatus of FIG. 8.

FIGS. 8 and 9 illustrate a further embodiment of coating apparatus at which there are arranged a positioning device 144, a printing device 146 and a dryer or drying device 148 in series behind one another. The conveyor device 149 contains an endless band-like perforated plate 150, which is constructed as an endless conveyor band or belt or can be formed of band-shaped perforated plate segments articulated to one another and arranged in a row. The band-shaped perforated plate 150 travels through both the positioning device 144, the printing device 146 as well as also the heating device 148. At each of these devices the band-shaped or band-like perforated plate 150 directly serves as a depository surface or depository means.

At the region of the positioning device 144 and the printing device 146 there is arranged in each instance a distributor chamber or compartment 152 which are connected by means of the connection conduits or lines 154 with the suction sides of blowers 156 serving as the suction mechanisms or devices. The abutting distributor chambers 152 are each equipped with perforated intermediate floors 158 which possess divider webs 160 directed towards the band-shaped perforated plate 150. Such serve to provide, on the one hand, a uniform suction action at the band-shaped perforated plate 150, and, on the other hand, a support device for the band-shaped perforated plate.

At the region of the positioning device 144 there are arranged stops or impact members 162, which can be structured to be adjustable, serving for the alignment of the blanks 4. These stops, after positioning of the blanks 4, can be raised, in order to render possible further conveying of the blanks.

The printing device 146 is again constructed as a screen printing machine, and the band-shaped perforated plate 150 simultaneously serves as a printing table. The printing frame 164 contains recesses 166 at the region of the band-shaped perforated plate 150, these recesses rendering possible application of the printing template 168 at the band-shaped perforated plate 150. The printing frame 164 is again equipped with a squeegee carriage 172 which is guided at the rails or tracks 170, squeegee carriage 172 containing a squeegee 174 or equivalent structure used for coating purposes. The band-shaped perforated plate 150 passes through the heating device 148 to a transfer or removal location 176 for the finished coated blanks 4.

The band-shaped or band-like perforated plate 150 is constructed as an endless conveyor band which is guided back from the transfer or removal location 176 by means of the deflection rolls 178 to the positioning device 144. A drive 180 serves for the intermittent drive of the band-shaped perforated plate 150, and a conveying step corresponds to the spacing A' between the positioning device 144 and the printing device 146. The band-shaped perforated plate 150 is advantageously structured such that it only possesses holes or apertures at the receiving regions for the blanks.

Figure 10:
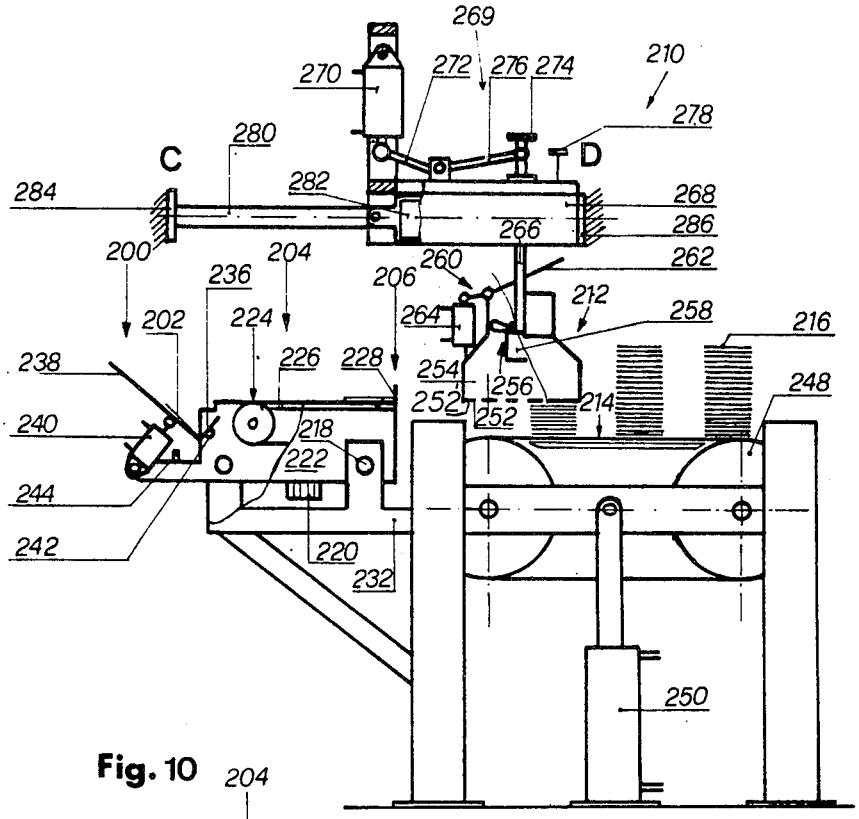
FIG. 10 illustrates in side view a stacking apparatus for the coated blanks.
Figure 11:
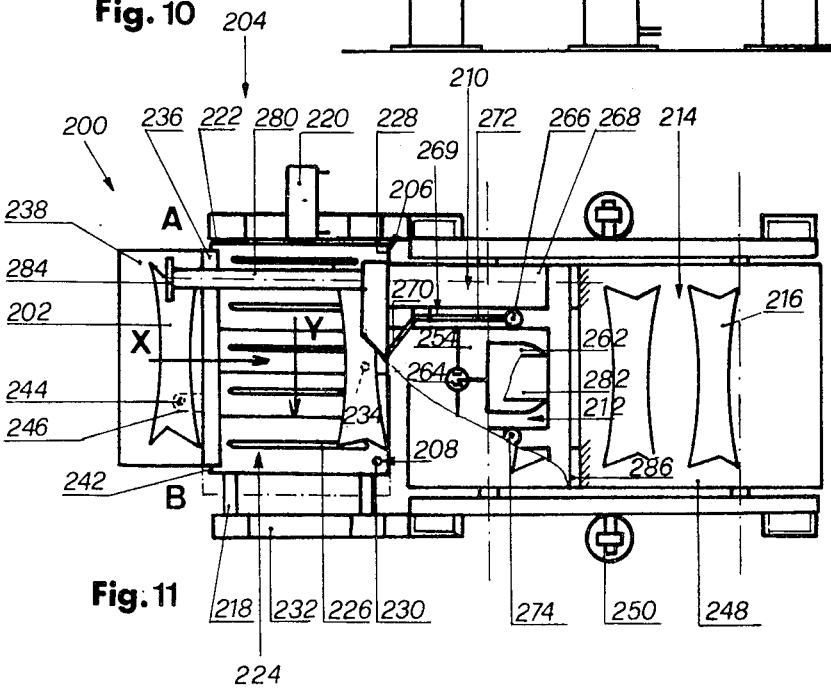
FIG. 11 is a top plan view of the stacking apparatus shown in FIG. 10.

Considering now the exemplary embodiment of stacking apparatus illustrated in FIGS. 10 and 11, and which constitutes subject matter of the commonly assigned copending U.S. application Ser. No. 767,665, filed Feb. 10, 1977, and entitled "Apparatus For The Aligned Stacking Of Blanks, Especially Cut From Textile Material.", the disclosure of which is incorporated herein by reference, such will be seen to contain a buffer or cushion device 200 for the reception and the pre-alignment of the blanks or cut pieces 202, which arrive in an unaligned condition. This buffer device 200 serves to deliver a pre-aligned blank 202 to an aligning device 204 disposed at the receiving location or position A. This aligning device 204 delivers the blank 202 in a first direction X towards a first aligning element 206. To permit alignment in a second direction Y the aligning device 204 can be shifted towards a second aligning element 208. A transfer device 210 embodying a transfer head 212 serves for the reception of a double-aligned blank in the alignment position B of the aligning device 204 and for transfer of the blank 202 to the stack depository means or storage 214 for forming a product stack 216.

The aligning device 204 contains a carriage 222 guided in the Y-direction at the guide rods 218 and displaceable from the receiving position A into the aligning position B by means of a preferably pneumatically actuated-actuation device or mechanism 220. This carriage 222 carries a conveyor device 224 which performs a conveying action upon the blanks in the X-direction. The conveyor device 224 embodies endless revolving belts 226 or equivalent structure arranged substantially in parallelism to one another and in spaced relation from one another. These belts 226 convey an incoming blank 202 against an impact or stop ledge 228 serving as the first aligning or alignment element 206. As the second aligning or alignment element 208 there is preferably utilized a detector 230 constructed as a light barrier. Detector 230 is arranged at the machine frame 232 and therefore is not displaceable along with the carriage 222. The detector 230 is responsive to a blank 202 which is moved in the Y-direction and serves to turn-off the actuation device 220. A further detector 234 is arranged in front of the impact or stop ledge 228 at the carriage 222 or at the machine fame 232. This further detector 234 responds to a blank 202 which arrives in the X-direction and turns-on the actuation device 220 with a certain time-delay in order to shift the carriage 222 in the Y-direction.

Continuing, it will be recognized that the carriage 222 carries the buffer or cushion device 200 which possesses a support means or support 238 which is inclined in the direction of an impact or stop ledge 236. This support 238 can be rocked about a shaft 242 in the direction of the conveying or conveyor device 224 — which shaft is arranged at the carriage 222 — by means of a preferably pneumatically actuated actuation-device 240. A detector 244, which preferably again is constructed as a light barrier, scans the support or support means 238 through an opening 246 for the arriving blanks 202.

The stack depository means or storage 214 is constructed, in the exemplary embodiment under discussion, as a stepwise conveying revolving conveyor 248 and can be lowered by means of a lifting device 250 at least approximately proportionally to the to the build-up of the stack 216. The lifting device 250 is preferably constructed as a pneumatic piston-and-cylinder unit.

The transfer head 212 of the transfer device 210 contains a perforated or apertured plate 252 for receiving a blank 202. This perforated plate 252 forms a wall of a distributor compartment or chamber 254. Further, the perforated plate 252 possesses a proportion of holes or apertures amounting to at least 10 percent, preferably at least 50 percent, of the plate surface or area. A conventional mask, merely generally indicated by reference character 252', can be provided for covering the parts of the plate 252 which are not employed for taking-up a blank. The distributor compartment or chamber 254 is operatively connected with a suction device or mechanism 256, preferably constructed as a blower 258. A closure device 260, arranged at the side of the blower, contains a cover 262 which can be selectively opened and closed by means of an actuation device 264, preferably constructed as a pneumatically operated-actuation device.

The transfer head 212 is mounted by means of guide rods 266 so as to be vertically movable up and down at a carriage 268. A lifting device 269, equipped with a preferably pneumatically constructed actuation device 270, engages through the agency of a coupling device 272 constructed as a fork or bifurcated unit, at flanges 274 of the guide rods 266. The coupling device 272 is constructed in such a manner that the arms 276 of the fork possess vertical play with respect to the flanges 274. With the actuation device 270 located in its starting or base position and with the transfer head 212 located upon the aligning device 204, the arms 276 therefore do not engage at the flanges 274, so that the transfer head 212, under the action of its inherent weight, bears upon the aligning device 204 or a blank located thereon. This is also the case when the transfer head 212 is seated upon a stack 216 of the stack storage or depository means 214. A detector 278 serves to sense the transfer head 212 at the aligning device 204 and/or the stack depository means 214 or the stack 216 respectively.

The carriage 268 is displaceable upon the rails 280 between the receiving or take-up position C at the aligning device 204 and the delivery position D at the stack storage 214. The drive is constituted by a preferably pneumatically constructed actuation device 282. The receiving position C and the delivery position D are determined by the stops 284 and 286 respectively.

Having now had the benefit of the foregoing description of the stacking apparatus its mode of operation will be now considered and is as follows:

A non-aligned blank 202 which arrives at the buffer or cushioning device 200, slides by means of the inclined support 238 towards the impact or stop ledge 236 and at that location is pre-aligned. The detector 244 senses the arriving blank 202 and places into operation the actuation device 240 as soon as the carriage 222 of the aligning device 204 is in the receiving or take-up position A. The pre-aligned blank 202 is tilted by means of the support 238 onto the conveyor device 224, which conveys the blank 202 in the X-direction towards the stop or impact ledge 228 and at that location aligns the same. The detector 234 determines the arrival of the blank 202 at the stop ledge 228 and triggers activation of the actuation device 220 which shifts the carriage 222 in the Y-direction until the detector 230 senses the edge of the blank and turns-off the actuation device 220.

Continuing, the detector 230 also triggers the lowering of the transfer head 212 which is located in the receiving or take-up position C. During the lowering of the transfer head 212 the cover 262 of the blower 258 is closed. If the transfer head 212 is seated at the aligning device 204 i.e. the blank 202, then, the detector 278 responds and triggers opening of the cover 262 by means of the actuation device 264. As a result, the blank 202 is sucked-up against the perforated plate 252. Then the actuation device 270 is activated, thereby lifting the transfer head 212, whereupon the carriage 268 is shifted by means of the actuation device 282 into the delivery position D. After arrival at the stop 286 the actuation device 270 is activated so as to operate in the opposite direction and causes lowering of the transfer head 212 onto the stack 216. As soon as the transfer head 212 is seated upon the stack 216, then, the detector 278 activates the actuation device 264, so that such closes the cover 262 and the suction force at the perforated plate 252 decreases. Thereafter, the actuation device 270 is activated, lifts the transfer head 212 and the actuation device 282 shifts the carriage 268 into the receiving position C which simultaneously constitutes the waiting or ready position, until a new blank activates the detector 230.

In order to form the stack 216 the stack depository means 214 is lowered an amount which is essentially proportional to the build-up of the stack. The lowering pulse can be triggered, for instance, by means of a conventional counter which is activated by the detector 230, and the lowering of the stack support 214 can occur either whenever there is deposited a blank or, preferably, after deposition of a predetermined number of blanks. Once the desired stack height is reached, — which again can be determined by means of the not particularly illustrated counter — the revolving conveyor is further indexed through one conveying step, so that the finished stack can arrive at a removal station.

In contrast to the illustrated exemplary embodiment it is of course possible to carry out a number of modifications. Thus, for instance, the aligning device can also be constructed such that is possesses a support for the blanks, which support is inclined in the direction of a first aligning element constructed as a stop ledge, in such a manner that the arriving blank slides against the stop ledge. This aligning device could be used instead of the illustrated conveyor device and would be constructed similar to the buffer or cushioning device. If an incoming blank is detected by means of a detector, then, an actuation device can horizontally position the storage or depository structure, so that the aligned blank, after shifting the aligning device towards the second aligning element, can be removed by means of the transfer head.

Instead of using the illustrated blower it would be possible to use other suction devices or mechanisms, such as for instance an injector. Also, there can be provided between the distributor compartment and the suction mechanism a switching or reversing mechanism, such as for instance a slide, which partially can connect the distributor chamber or compartment with the suction side or the blower side of the suction mechanism, or, however, also with the atmosphere. Such construction is advantageous, for instance, when working with blanks which are difficult to handle. Depending upon the extent of the connection of the distributor chamber with the suction side, it is possible to vary the suction air current. For transferring the blank it is then possible for the switching device or mechanism to connect the distributor chamber either partially or completely with the blower side or the suction side or with the atmosphere, depending upon how easily the blank can be stripped from the transfer head.

The transfer head can also possess a plate for receiving the blank and having protruding needles for penetration into the blank. In order to remove the blank there can be employed a stripper actuated by means of an actuation device.

In the illustrated exemplary embodiment the stack depository means or storage for forming the stack can be lowered. Yet, it is also possible to construct the stack storage so that it is not displaceable in vertical direction, in which case then the lifting device of the transfer device would be constructed such that the transfer head at least can be raised through a height corresponding to the stack to be formed.

With the exemplary illustrated embodiment the different actuation devices and drives are preferably pneumatically operated, for instance constructed as pneumatic piston-and-cylinder units. However, other constructions of the actuation devices are possible, such as for instance mechanical, electrical, electro-magnetic and hydraulic actuation devices and drives could be employed. Also hybrid systems can be used.

While there are shown and described present preferred embodiments of the invention, it is to be distinctly understood that the invention is not limited thereto, but may be otherwise variously embodied and practiced within the scope of the following claims.

What is claimed is:

1. An apparatus for automatically, at least zone-wise, coating blanks, especially clothing inserts, formed of textile material, comprising:

a device for the successive exact positioning of at least one blank;

a coating device for the successive, at least zone-wise, coating of at least one blank;

a heating device for the thermal treatment of the coated blanks;

a conveyor device for the exact aligned transfer of the blanks from one device to the other; said conveyor device comprising: distributor chamber means;

blower means including a suction side;

means for connecting the distributor chamber means the suction side of the blower means;

a perforated plate serving to receive at least one blank and forming a wall of said distributor chamber means;

said perforated plate having a proportion of perforations amounting to at least 10 percent of the surface area of said perforated plate.

2. The apparatus as defined in claim 1, wherein:

said positioning device comprises a perforated plate for the deposition of a blank thereon.

3. The apparatus as defined in claim 1, wherein:

said coating device comprises a printing device.

4. The apparatus as defined in claim 3, wherein:

said printing device is a screen printing machine.

5. The apparatus as defined in claim 1, wherein:

said coating device comprises a coating table equipped with a perforated plate serving as a deposit surface for the blanks;

distributor chamber means provided for said coating table;

said perforated plate forming a wall of said distributor chamber means of said coating table;

blower means including a suction side provided for said coating device; and means for connecting the distributor chamber means of the coating table with the suction side of the blower means for said coating device.

6. The apparatus as defined in claim 5, wherein: said perforated plate of the coating table has a proportion of perforations amounting to at least 50 percent of the surface area of said plate.

7. The apparatus as defined in claim 5, wherein:

said perforated plate of said coating table includes portions which are not employed for the deposition of a blank and which portions are covered by a mask.

8. The apparatus as defined in claim 1, wherein:

said perforations of said perforated plate amount to at least 50 percent of the surface area of said perforated plate.

9. The apparatus as defined in claim 8, wherein:

said perforated plate includes portions which are not employed for the deposition of a blank and which portions are covered by a mask.

10. An apparatus for coating blanks, especially clothing inserts, formed of textile material, comprising:

a device for the successive positioning of at least one blank;

a coating device for the successive coating of at least one blank, said coating device comprising a coating table equipped with a perforated plate serving as a deposit surface for the blanks;

a heating device for the thermal treatment of the coated blanks;

a conveyor device for the transfer of the blanks from one device to the other;

said conveyor device comprising;

distributor chamber means provided for said coating table;

blower means provided for said coating device and including a suction side and a blower side;

means for connecting the distributor chamber means of the coating table with the suction side of the blower means;

a perforated plate serving to receive at least one blank and forming a wall of said distributor chamber means of said coating table;

said perforated plate having a proportion of perforations amounting to at least 10 percent of the surface area of said perforated plate;

connection conduit means arranged between the distributor chamber means of the coating table and said blower means of the coating device; and switching means for connecting said connection conduit means with said blower means;

said switching means being switchable between the suction side and the blower side of the blower means in such manner that the connection conduit means is connected with the suction side for fixedly retaining a blank and is at least partially connected with the blower side of said blower means for the release of a blank.

11. The apparatus as defined in claim 10, wherein: said switching means comprises a slide.

12. An apparatus for coating blanks, especially clothing inserts, formed of textile material, comprising:

a device for the successive positioning of at least one blank;

a coating device for the successive coating of at least one blank, said coating device comprising a coating table equipped with a perforated plate serving as a deposit surface for the blanks;

a heating device for the thermal treatment of the coated blanks;

a conveyor device for the transfer of the blanks from one device to the other;

said conveyor device comprising:

distributor chamber means provided for said coating table;

blower means provided for said coating device and including a suction side;

means for connecting the distributor chamber means of the coating table with the suction side of the blower means for the coating device;

a perforated plate serving to receive at least one blank and forming a wall of said distributor chamber means of said coating table;

said perforated plate having a proportion of perforations amounting to at least 10 percent of the surface area of said perforated plate;

means mounting said coating table to be freely displaceable between two terminal positions, one of which defines a blank coating position and the other of which defines a receiving and transfer position; and a respective pulse transmitter effective at said coating position and said receiving and transfer position serving as drive means for moving the freely movable coating table from its assumed terminal position into its other terminal position.

13. The apparatus as defined in claim 12, wherein:

each of said pulse transmitters comprises a fluid actuated pulse transmitter.

14. The apparatus as defined in claim 12, further including:

a brake-aligning device provided for said coating device for both terminal positions of said coating table.

15. The apparatus as defined in claim 14, further including:

a bracket provided for said coating table;

said brake-aligning device comprising an overhang arm equipped with a roll;

said overhang arm being directed towards the arriving coating table when assuming a braking position;

said roll cooperating with said bracket;

spring support means;

bearing means for mounting said overhang arm at said spring support means;

a spring provided for said spring support means for pre-biasing said overhang arm against said bearing means in such a manner that the line of action of said spring in the braking position and in the aligning position, respectively, of said overhang arm is located in each instance at opposite sides of said bearing means, so that said overhang arm in the braking position counteracts the movement of the coating table and in the aligning position presses against a stop means.

16. An apparatus for coating blanks, especially clothing inserts, formed of textile material, comprising:

a device for the successive positioning of at least one blank;

a coating device for the successive coating of at least one blank;

a heating device for the thermal treatment of the coated blanks;

a conveyor device for the transfer of the blanks from one device to the other;

said conveyor device comprising:

distributor chamber means;

blower means including a suction side;

means for connecting the distributor chamber means with the suction side of the blower means;

a perforated plate serving to receive at least one blank and forming a wall of said distributor chamber means;

said perforated plate having a proportion of perforations amounting to at least 10 percent of the surface area of said perforated plate;

means for delivering a coating agent to said coating device; and control means for adjusting the intervals between the conveying cycles of the delivering means, said control means serving to adjust the length of the conveying cycles of said delivering means.

17. An apparatus for coating blanks, especially clothing inserts, formed of textile material, comprising:

a device for the successive positioning of at least one blank;

a coating device for the successive coating of at least one blank;

a heating device for the thermal treatment of the coated blanks;

a conveyor device for the transfer of the blanks from one device to the other;

said conveyor device comprising:

distributor chamber means;

blower means including a suction side;

means for connecting the distributor chamber means with the suction side of the blower means;

a perforated plate serving to receive at least one blank and forming a wall of said distributor chamber means;

said perforated plate having a proportion of perforations amounting to at least 10 percent of the surface area of said perforated plate;

said positiong device, said coating device and said heating device being arranged along a pitch circle in a substantially merry-go-round configuration and at substantially the same angular spacing from one another.

18. The apparatus as defined in claim 1, wherein:

said conveyor device comprises at least one elevationally displaceable transfer head containing a perforated plate;

19. The apparatus as defined in claim 1, wherein:

said conveyor device comprises two interconnected, elevationally displaceable transfer heads;

each of said transfer heads containing a perforated plate;

each of said perforated plates moving to-and-fro synchronously between the positioning device and the coating device and between the coating device and the heating device.

20. The apparatus as defined in claim 19 wherein:

each perforated plate of said transfer heads includes a portion which does not participate in the reception of a blank;

each said plate portion being covered by a mask.

21. The apparatus as defined in claim 19, wherein:

said transfer heads each being freely movable between two terminal positions;

drive means comprising pulse transmitter means for driving the transfer heads into each terminal position;

each pulse transmitter means displacing the freely movable transfer head from the one terminal position into the other terminal position.

22. The apparatus as defined in claim 21, further including:

a brake-aligning device provided for both terminal positions of the transfer heads.

23. The apparatus as defined in claim 22, wherein:

said brake-aligning device comprises an overhang arm having a roll mounted thereat;

a bracket cooperating with said roll;

said overhang arm when assuming its braking position being directed towards the arriving transfer head;

spring support means;

bearing means for mounting said overhang arm at said spring support means;

a spring provided for said spring support means for pre-biasing said overhang arm against said bearing means in such a manner that the line of action of said spring in the braking position and in the aligning position, respectively, of the overhang arm is located in each instance at opposite sides of said bearing means, so that said overhang arm in the braking position opposes the movement of the transfer heads and presses such in the aligning position against a stop.

24. An apparatus for coating blanks, especially clothing inserts, formed of textile material, comprising:

a device for the successive positioning of at least one blank;

a coating device for the successive coating of at least one blank;

a heating device for the thermal treatment of the coated blanks;

a conveyor device for the transfer of the blanks from one device to the other;

said conveyor device comprising:

distributor chamber means;

blower means including a suction side;

means for connecting the distributor chamber means with the suction side of the blower means;

a cover for closing said blower means;

actuation means for opening said cover for the reception of a blank and for closing said cover for the release of such blank; and a perforated plate serving to receive at least one blank and forming a wall of said distributor chamber means;

said perforated plate having a proportion of perforations amounting to at least 10 percent of the surface area of said perforated plate.

25. An apparatus for coating blanks, especially clothing inserts, formed of textile material, comprising:

a device for the successive positioning of at least one blank;

a coating device for the successive coating of at least one blank;

a heating device for the thermal treatment of the coated blanks;

a conveyor device for the transfer of the blanks from one device to the other;

said conveyor device comprising:

distributor chamber means;

blower means including a suction side and a blower side;

means for connecting the distributor chamber means with the suction side of the blower means;

said connecting means for connecting the distributor chamber means with the suction side of the blower means including a connection conduit;

switching means for selectively connecting the connection conduit with the suction side of the blower means for the reception of a blank and at least partially with the blower side of the blower means for the delivery of such blank; and a perforated plate serving to receive at least one blank and forming a wall of said distributor chamber means;

said perforated plate having a proportion of perforations amounting to at least 10 percent of the surface area of said perforated plate.

26. The apparatus as defined in claim 25, wherein: said switching means comprises a slide.

27. The apparatus as defined in caim 1, wherein:

said perforated plate comprises a substantially band-shaped and endless structure which at least travels closely over the positioning device and the coating device;

said band-shaped perforated plate being arranged at least at the region of the positioning device and the coating device and moving over the distributor chamber means connected with said blower means; and said positioning device serving as depository means for the blanks and said coating device as a coating table for the blanks.

28. The apparatus as defined in claim 27 wherein:

said band-shaped perforated plate travels through said heating device.

29. An apparatus for coating blanks, especially clothing inserts, formed of textile material, comprising:

a device for the successive positioning of at least one blank;

a coating device for the successive coating of at least one blank;

a heating device for the thermal treatment of the coated blanks;

a conveyor device for the transfer of the blanks from one device to the other;

said conveyor device comprising:

distributor chamber means;

blower means including a suction side;

means for connecting the distributor chamber means with the suction side of the blower means;

a perforated plate serving to receive at least one blank and forming a wall of said distributor chamber means;

said perforated plate having a proportion of perforations amounting to at least 10 percent of the surface area of said perforated plate;

a stacking device arranged after said heating device for the aligned stacking of said blanks arriving in a non-aligned condition;

said stacking device comprising:

a first aligning element;

aligning means for conveying a blank in a first predetermined direction towards said aligning element;

means providing a stack depository for depositing thereon an aligned stack of said blanks;

transfer means including a transfer head movable to-and-fro between the aligning means located in an aligning position and said stack depository means for transferring an aligned blank to the stack depository means;

a second aligning element; and means for displacing the aligning means in a second predetermined direction for aligning a blank at said second aligning element.

30. The apparatus as defined in claim 29, wherein:

said first aligning element comprises an impact ledge;

said aligning means comprises a conveyor means for conveying the blanks in said first predetermined direction towards said impact ledge.

31. The apparatus as defined in claim 30, wherein:

said conveyor means comprises a belt conveyor mechanism composed of revolving, endless belts arranged in substantially parallel spaced relationship to one another.

32. The apparatus as defined in claim 29, further including:

drive means for driving said aligning means;

said second aligning element comprising a detector responsive to an arriving blank;

said detector turning-off said drive means of said aligning means upon responding to said arriving blank.

33. The apparatus as defined in claim 32, wherein:

said detector triggers a blank transfer movement of said transfer head.

34. The apparatus as defined in claim 32, wherein:

said detector comprises light barrier means.

35. The apparatus as defined in claim 29, further including:

a detector responsive to a blank and arranged forwardly of said first aligning element;

said detector, when responding, triggering movement of said aligning means in said second predetermined direction.

36. The apparatus as defined in claim 35, wherein:

said detector comprises light barrier means.

37. The apparatus as defined in claim 29, further including:

buffer means arranged forwardly of said aligning means;

a detector provided for said buffer means;

said detector, when responding and with said aligning means located in a blank receiving position, triggering transfer of a blank to said aligning means.

38. The apparatus as defined in claim 37, wherein:

said detector comprises light barrier means.

39. The apparatus as defined in claim 29, wherein:

said stack depository means comprises a stepwise conveying revolving conveyor means.

40. The apparatus as defined in claim 29, wherein said stacking device further includes:

suction means;

distributor chamber means provided for said transfer head operatively connected with said suction means;

said transfer head incorporating a perforated plate for taking-up a blank;

said perforated plate forming a wall of said distributor chamber means of said transfer head.

41. The apparatus as defined in claim 40, wherein:

said suction means comprises a blower.

42. The apparatus as defined in claim 40, wherein:

said suction means includes a suction side and a blower side;

switching means for selectively switching said distributor chamber means at least partially with the suction side or the blower side of said suction means or the atmosphere.

43. The apparatus as defined in claim 42, wherein:

said switching means comprises slide means.

44. The stacking apparatus as defined in claim 40, wherein:

said suction means contains a blower side;

closure means provided for said suction means at the blower side thereof;

an actuation mechanism for actuating said closure means;

said closure means being closed during the reception of a blank and being open during the delivery of such blank.

45. The apparatus as defined in claim 40, wherein:

said perforated plate of said transfer head includes a perforated portion, wherein the density of the perforations thereof amounts to at least 10 percent of the surface area of said plate.

46. The apparatus as defined in claim 45, wherein:

the perforation density of said perforations amounts to at least 50 percent of the surface area of said plate.

47. The apparatus as defined in claim 40, wherein:

said perforated plate of said transfer head includes a plate portion which does not participate in the reception of a blank;

a mask for covering said plate portion.

48. The apparatus as defined in claim 29, wherein:

said transfer head serves to receive a blank and comprises a plate having protruding needles for penetration into the blank; and stripper means for stripping the blank from the needles.

49. The apparatus as defined in claim 29, further including:

carriage means at which there is arranged said transfer head;

said carriage means being movable between an aligning position of the aligning means and said stack depository means;

lifting means provided for said transfer head for raising and lowering said transfer head onto said aligning means and said stack depository means.

50. The apparatus as defined in claim 49, further including:

coupling means for coupling said lifting means with play with said transfer head in such a manner that said transfer head bears under the influence of its inherent weight upon the aligning means or the stack depository means and the stack of blanks supported thereon.

51. The apparatus as defined in claim 49, wherein:

said lifting means is structured such that said transfer head can be elevationally shifted at least through the height of the stack of blanks which is to be formed.

52. The apparatus as defined in claim 29, further including:

a detector provided for said transfer means;

said detector being selectively responsive to at least any one of the deposit position of the transfer head upon the aligning means, the stack depository means and the stack of blanks.

53. An apparatus for automatically, at least zonewise, coating blanks, especially clothing inserts, formed of textile material, comprising:

a device for the selective exact positioning of at least one blank;

a coating device for the coating of at least one blank;

a heating device for the thermal treatment of the coated blanks;

a conveyor device for the exact aligned transfer of the blanks from one device to the other;

said conveyor device being provided with at least one distributor chamber means;

blower means;

means for connecting the distributor chamber means with said blower means;

a perforated plate serving to receive at least one blank and forming a wall of said distributor chamber means;

said perforated plate having a proportion of perforations amounting to at least 10 percent of the surface area of said perforated plate.

54. The apparatus as defined in claim 1, further including:

cover means for closing said blower means; and actuation means opening said cover means for the reception of a blank and closing said cover for releasing such blank.

55. The apparatus as defined in claim 1, wherein:

said connecting means includes a connection conduit;

said blower means having a blower side; and switching means for selectively connecting the connection conduit with the suction side of the blower means for the reception of a blank and at least partially with the blower side of the blower means for the delivery of such blank.

* * * * *